US011551597B2

(12) United States Patent
Chang et al.

(10) Patent No.: US 11,551,597 B2
(45) Date of Patent: Jan. 10, 2023

(54) ELECTRONIC DEVICE

(71) Applicant: E Ink Holdings Inc., Hsinchu (TW)

(72) Inventors: Chia-Chi Chang, Hsinchu (TW); Chih-Chun Chen, Hsinchu (TW); Chi-Ming Wu, Hsinchu (TW); Yi-Ching Wang, Hsinchu (TW); Jia-Hung Chen, Hsinchu (TW); Shu-Fen Tsai, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 0 days.

(21) Appl. No.: 17/200,907

(22) Filed: Mar. 15, 2021

(65) Prior Publication Data

US 2021/0358371 A1 Nov. 18, 2021

(30) Foreign Application Priority Data

May 18, 2020 (TW) ..... 109116345

(51) Int. Cl.
*G09G 3/20* (2006.01)

(52) U.S. Cl.
CPC ..... *G09G 3/20* (2013.01); *G09G 2300/0408* (2013.01); *G09G 2310/0278* (2013.01)

(58) Field of Classification Search
CPC ..... G09G 3/20; G09G 2300/0408; G09G 2310/0278
See application file for complete search history.

(56) References Cited

U.S. PATENT DOCUMENTS 8,502,275 B2 8/2013 Chang
8,988,471 B2 3/2015 Al-Dahle et al.
9,013,384 B2 4/2015 Al-Dahle et al.
9,064,464 B2 6/2015 Saeedi et al.
9,530,365 B2 12/2016 Shi et al.
2007/0132902 A1 6/2007 Yao
2013/0328759 A1 12/2013 Al-Dahle et al.
(Continued)

FOREIGN PATENT DOCUMENTS

CN 108401357 8/2018
TW I680331 12/2019

OTHER PUBLICATIONS

"Office Action of Taiwan Counterpart Application", dated Oct. 16, 2020, p. 1-p. 11.

*Primary Examiner* — Sejoon Ahn
(74) *Attorney, Agent, or Firm* — JCIPRNET

(57) ABSTRACT

An electronic device including a substrate, a plurality of first signal lines, and a plurality of second signal lines is provided. The first signal lines are disposed on the substrate. Each of the first signal lines includes a first intersecting section and a first extending section. The first intersecting section each has a constant extending direction. The first intersecting section is connected to the first extending section, while the first intersecting section and the first extending section have different extending directions. The second signal lines are disposed on the substrate. Each of the second signal lines includes a second intersecting section. The second intersecting section each has a constant extending direction. The second signal lines intersect with the first signal lines to form a plurality of intersections on each of the first signal lines, and the intersections are located on the first intersecting sections.

18 Claims, 3 Drawing Sheets

(56) References Cited

U.S. PATENT DOCUMENTS

| | | | | |
|---|---|---|---|---|
| 2015/0228218 | A1* | 8/2015 | Shim | G09G 3/2096 345/205 |
| 2017/0038888 | A1* | 2/2017 | Qu | G06F 3/0446 |
| 2017/0219895 | A1 | 8/2017 | Yu et al. | |
| 2017/0277008 | A1 | 9/2017 | Jiang et al. | |
| 2018/0239477 | A1* | 8/2018 | Yang | G09G 3/2074 |
| 2018/0356684 | A1 | 12/2018 | Chang et al. | |

* cited by examiner

ELECTRONIC DEVICE

CROSS-REFERENCE TO RELATED APPLICATION

This application claims the priority benefit of Taiwan patent application serial no. 109116345, filed on May 18, 2020. The entirety of the above-mentioned patent application is hereby incorporated by reference and made a part of this specification.

BACKGROUND

Technical Field

The disclosure relates to a device, and particularly to an electronic device.

Description of Related Art

With the diverse development of electronic devices, the layout of signal lines of various electronic devices has become more and more complicated, which may pose an impact on the performance of the electronic devices. For instance, a number of signal lines may have to be made from different film layers, and the layout of the signal lines may appear to be arranged in an interlacing manner. Thereby, the coupling relationship between the signal lines is bound to affect the signal transmission effect of the signal lines. In some electronic devices, such a coupling effect may lead to inconsistent signal transmission effects of the signal lines, and the performance of the electronic devices is accordingly deteriorated. Therefore, the design of the signal lines of the electronic devices is also an issue that cannot be ignored.

SUMMARY

The disclosure provides an electronic device with an arranged signal line layout to achieve desired performance.

An embodiment of the disclosure provides an electronic device that includes a substrate, a plurality of first signal lines, and a plurality of second signal lines. The first signal lines are disposed on the substrate. Each of the first signal lines includes at least one first intersecting section and at least one first extending section. Each of the at least one first intersecting section has a constant extending direction. The at least one first intersecting section is connected to the at least one first extending section, and the at least one first intersecting section and the at least one first extending section have respective expending directions. The second signal lines are disposed on the substrate. The second signal lines interlace with the first signal lines to form a plurality of intersections on each of the first signal lines, and all of the intersections are located on the at least one first intersecting section.

In an embodiment of the disclosure, a quantity of the at least one first extending section is two, and the at least one first intersecting section is located between the two first extending sections to form two first corners at two ends of the at least one first intersecting section.

In an embodiment of the disclosure, the intersections are located between the two first corners.

In an embodiment of the disclosure, each of the second signal lines further includes two sections of second extending section, a second intersecting section and two second extending sections, and the second intersecting section is located between the two second extending sections to form two second corners at two ends of the second intersecting section.

In an embodiment of the disclosure, the intersections are located between the two second corners.

In an embodiment of the disclosure, the at least one first intersecting section has a constant line width.

In an embodiment of the disclosure, the second intersecting section has a constant line width.

In an embodiment of the disclosure, the substrate has an active region and a driving region, and the first signal lines and the second signal lines extend between the active region and the driving region.

In an embodiment of the disclosure, the electronic device further includes a plurality of scan lines, a plurality of data lines, and a plurality of active devices. The scan lines, the data lines, and the active devices are disposed on the substrate and located in the active region, and each of the active devices is connected to one of the scan lines and one of the data lines.

In an embodiment of the disclosure, the scan lines are connected to the first signal lines, and the data lines are connected to the second signal lines.

In an embodiment of the disclosure, at least two of the scan lines are connected to one of the first signal lines.

In an embodiment of the disclosure, the electronic device further includes a driving circuit. The driving circuit is disposed on the substrate and located in the driving region.

In an embodiment of the disclosure, the driving circuit includes chip on glass (COG) or chip on film (COF).

In an embodiment of the disclosure, the active region is a rectangular active region or a non-rectangular active region.

In an embodiment of the disclosure, the at least one first extending section does not interlace with or overlap the second signal lines.

In an embodiment of the disclosure, the second extending section does not interlace with or overlap the first signal lines.

In an embodiment of the disclosure, a quantity of the at least one first intersecting section is two, the at least one first extending section is connected between the two first intersecting sections, the two first intersecting sections have respective constant extending directions, and the respective constant extending directions are different.

In an embodiment of the disclosure, except for the two first intersecting sections, none of the plurality of first signal lines interlace with the plurality of second signal lines.

In an embodiment of the disclosure, each of the second signal lines includes two second intersecting sections and a second extending section. The second extending section is connected between two second intersecting sections. The two second intersecting sections have respective constant extending directions, and the respective constant extending directions are different.

In an embodiment of the disclosure, except for the two second intersecting sections, none of the plurality of second signal lines interlace with the plurality of first signal lines.

In light of the foregoing, the electronic device provided in one or more embodiments of the disclosure adjusts the arrangement of the signal lines, so that the intersections of different signal lines have roughly the same interlacing areas. Thereby, the signal transmission quality of each signal line is approximately the same, and a uniform signal transmission effect may be achieved.

Several exemplary embodiments accompanied with figures are described in detail below to further describe the disclosure in details.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
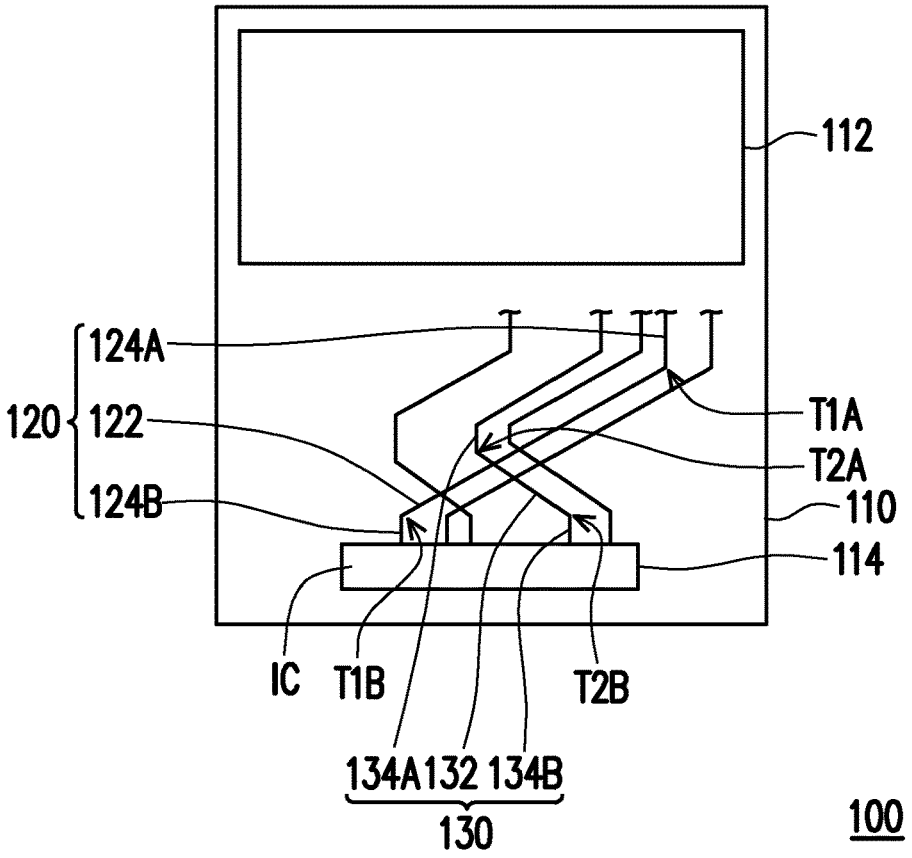
FIG. 1 is a schematic diagram of an electronic device according to an embodiment of the disclosure.

FIG. 1 is a schematic diagram of an electronic device according to an embodiment of the disclosure. In FIG. 1, the electronic device 100 includes a substrate 110, a plurality of first signal lines 120, and a plurality of second signal lines 130. The first signal lines 120 and the second signal lines 130 are disposed on the substrate 110. The first signal lines 120 may interlace with the second signal lines 130, and the first signal lines 120 and the second signal lines 130 may be made of materials of different layers, so the first signal lines 120 and the second signal lines 130 are not directly connected and may independently transmit different signals. In some embodiments, at least one insulation layer and/or other conductive layers and semiconductor layers may be disposed between the film layer where the first signal lines 120 are located and the film layer where the second signal lines 130 are located.

The substrate 110 is a plate which has a certain supportability and allows the first signal lines 120, the second signal lines 130, and/or other components to be disposed thereon and still remains intact without deformation and damage. A material of the substrate 110 may include glass, quartz, an organic polymer, metal, or the like. The organic polymer for making the substrate 110 includes, for instance, polyimide (PI), polyethylene terephthalate (PET), polycarbonate (PC), and the like. In some embodiments, the substrate 110 is a rigid substrate and is not flexible. However, in other embodiments, the substrate 110 may be a flexible substrate. At this time, the electronic device 100 may be a flexible product, which should however not be construed as a limitation in the disclosure.

The substrate 110 may have an active region 112 and a driving region 114. The active region 112 may be equipped with components for providing specific functions. For instance, the active region 112 may be equipped with a display pixel circuit, a touch circuit, or a combination thereof. In some embodiments, a display medium (such as a liquid crystal layer, an electrophoretic material layer, an electrowetting material layer, an electroluminescent layer, etc.) may be disposed on the substrate 110, and the display pixel circuit in the active region 112 may be configured to drive the display medium to achieve the display function. In addition, the touch circuit disposed in the active region 112 may be configured to achieve the touch operation function. A driving circuit IC may be disposed in the driving region 114 and configured to provide a signal to control circuit components in the active region 112 and/or receive the signal provided by the circuit components in the active region 112. The driving circuit IC may include chip-on-glass (COG) or chip-on-film (COF), which should however not be construed as a limitation in the disclosure. In some embodiments, the driving circuit IC may be integrated on the substrate to achieve a driver on array design. In FIG. 1, the active region 112 is illustrated as a rectangular active region, but in other embodiments, the active region 112 may be a non-rectangular active region. When the active region 112 is a non-rectangular active region, the substrate 110 may also be compliantly designed to have a non-rectangular shape, and the electronic device 100 may be a non-rectangular device, which should however not be construed as a limitation in the disclosure.

The first signal lines 120 are disposed on the substrate 110 and are connected between the active region 112 and the driving region 114. The first signal lines 120 may be divided into a plurality of sections extending in different directions. For instance, the first signal lines 120 may include a first intersecting section 122, a first extending section 124A, and a first extending section 124B. The first intersecting section 122 is connected to the first extending section 124A, and the first intersecting section 122 is connected to the first extending section 124B. In the embodiment, the first extending section 124A and the first extending section 124B are located at both ends of the first intersecting section 122 and are directly connected to the first intersecting section 122.

Each of the first intersecting section 122, the first extending section 124A, and the first extending section 124B has a constant extending direction. In other words, the first intersecting section 122 is a straight line segment, and the first extending section 124A and the first extending section 124B may both be straight line segments. However, the extending direction of the first intersecting section 122 is different from the extending direction of the first extending section 124A and the extending direction of the first extending section 124B. The extending direction of the first extending section 124A may be optionally different from the extending direction of the first extending section 124B. Therefore, in each of the first signal lines 120, the first intersecting section 122 is connected to the first extending section 124A to form a first corner T1A, and the first intersecting section 122 is connected to the first extending section 124B to form a first corner T1B.

The second signal lines 130 are also disposed on the substrate 110 and connected between the active region 112 and the driving region 114. The second signal lines 130 may also be divided into a plurality of sections extending in different directions. For instance, the second signal lines 130 may include a second intersecting section 132, a second extending section 134A, and a second extending section 134B. The second intersecting section 134A is connected to the second extending section 132, and the second intersecting section 134B is connected to the second extending section 132. In the embodiment, the second extending section 134A and the second extending section 134B are located at both ends of the second intersecting section 132 and are directly connected to the second intersecting section 132.

Each of the second intersecting section 132, the second extending section 134A, and the second extending section 134B has a constant extending direction. That is, the second intersecting section 132 is a straight line segment, and the second extending section 134A and the second extending section 134B may both be straight line segments. However, the extending direction of the second intersecting section 132 is different from the extending direction of the second extending section 134A and the extending direction of the second extending section 134B. The extending direction of the second extending section 134A may be optionally different from the extending direction of the second extending section 134B. Therefore, in each of the second signal lines 130, the second intersecting section 132 is connected to the second extending section 134A to form a second corner T2A, and the second intersecting section 132 is connected to the second extending section 134B to form a second corner T2B.

Figure 2:
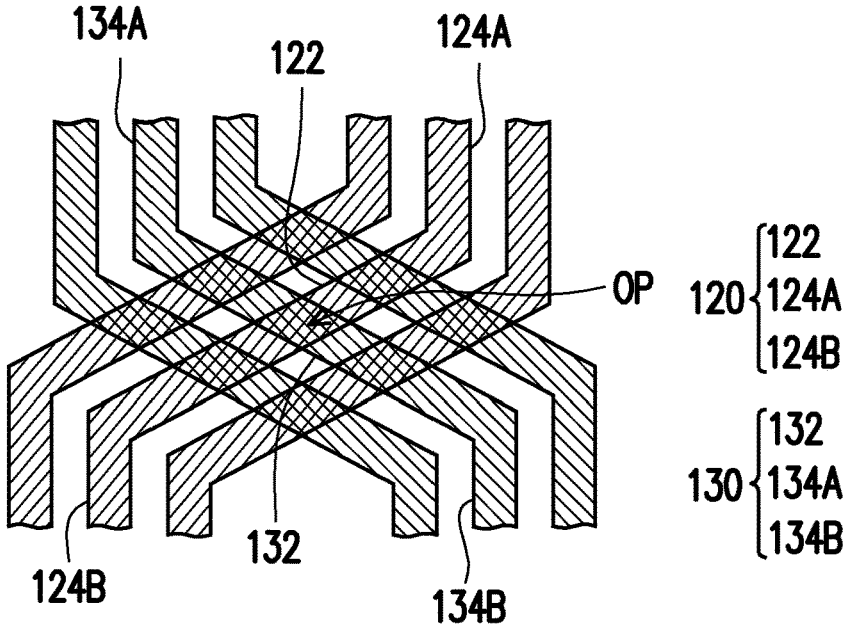
FIG. 2 is a schematic partially enlarged diagram of the first signal lines and the second signal lines in the electronic device depicted in FIG. 1.

FIG. 2 is a schematic partially enlarged diagram of the first signal lines and the second signal lines in the electronic device depicted in FIG. 1. With reference to FIG. 1 and FIG. 2, the second signal lines 130 interlace with the first signal lines 120 to form a plurality of intersections OP on the same first signal lines 120, and the intersections OP are all located on the first intersecting sections 122 of the first signal lines 120. Specifically, the intersections OP on the first signal lines 120 are all located between the first corners T1A and the first corners T1B, and the intersections OP on the second signal lines 130 are located between the second corners T2A and the second corners T2B. In the embodiment, the first extending sections 124A and 124B do not interlace with or overlap the second signal lines 130, and the second extending sections 134A and 134B do not interlace with or overlap the first signal lines 120. Therefore, the intersections OP where the first signal lines 120 intersect with and overlap the second signal lines 130 all fall on the straight first intersecting sections 122 and the straight second intersecting sections 132. In other words, the intersection OP on each of the first signal lines 120 is arranged along the same straight line, and the intersection OP on each of the second signal lines 130 is arranged along the same straight line.

In the embodiment, each of the first signal lines 120 intersects with N second signal lines 130, and similarly, each of the second signal lines 130 intersects with M first signal lines 120, where N and M are positive integers. Therefore, the number of intersections OP on each of the first signal lines 120 is equal, and the number of intersections OP on each of the second signal lines 130 is equal. In addition, the first intersecting section 122 and the second intersecting section 132 have, for instance, constant widths; that is, the width of the first intersecting section 122 and the width of the second intersecting section 132 do not change substantially, or changes to the widths of the first intersecting section 122 and the second intersecting section 132 are not significant. Thereby, the area of the intersection OP where each of the first signal lines 120 intersects with and overlap different second signal lines 130 may be approximately the same. Similarly, the area of the intersection OP where each of the second signal lines 130 intersects with and overlap different first signal lines 120 may be approximately the same.

In the embodiment, the area and the number of intersections OP on different first signal lines 120 are approximately the same. Therefore, different first signal lines 120 may be subject to similar resistance-capacitance delay effect because the coupling capacitance generated through overlapping different first signal lines 120 with the second signal lines 130 is approximately the same. As such, different first signal lines 120 may provide similar signal transmission properties. Similarly, different second signal lines 130 are also subject to similar resistance-capacitance delay effect and may provide similar signal transmission properties. Accordingly, the electronic device 100 may prevent the influence resulting from the non-uniform transmission properties of the first signal lines 120 or the second signal lines 130, so as to ensure the desired quality.

Figure 3:
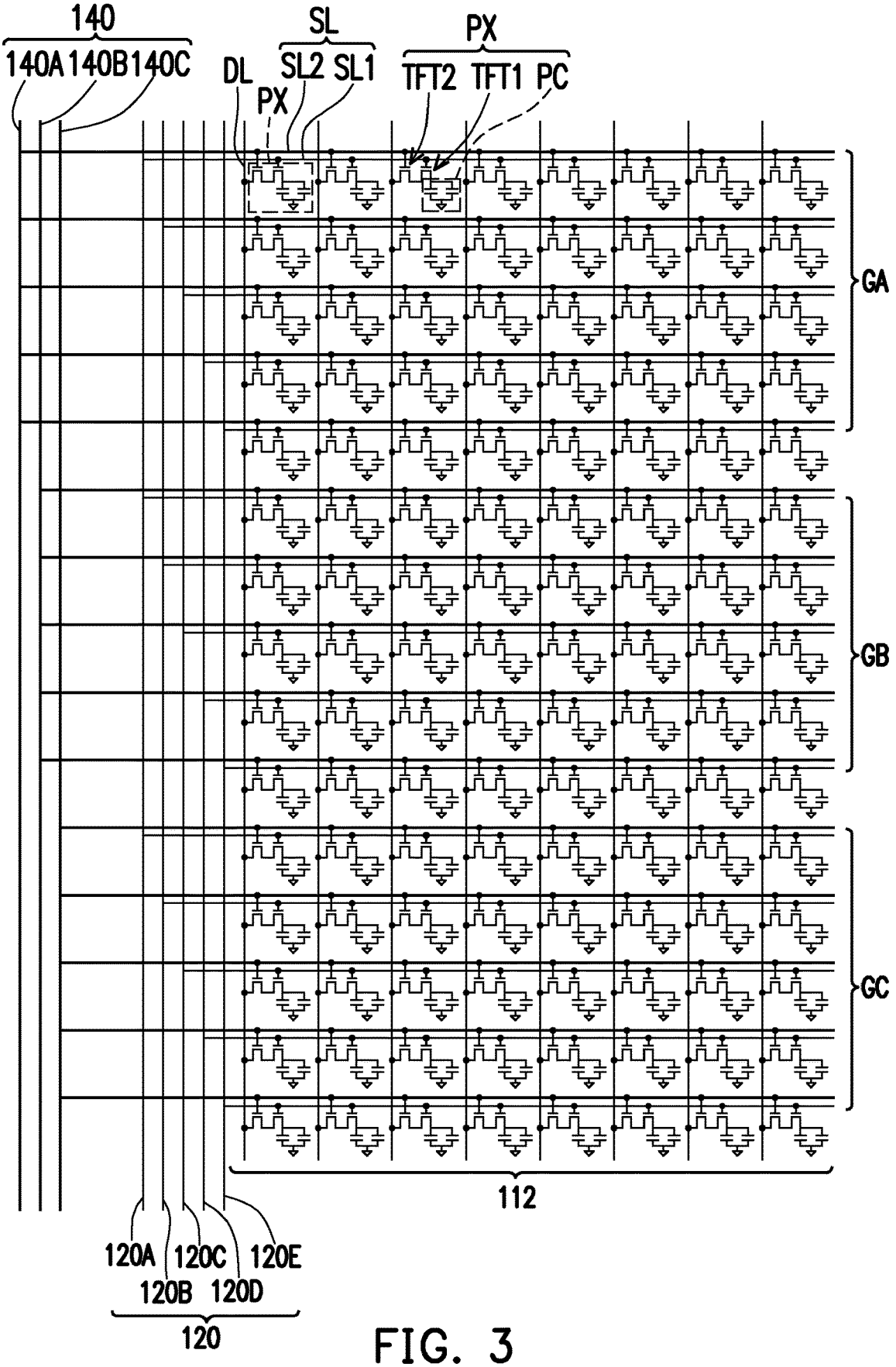
FIG. 3 is a schematic diagram of a portion of an active region of an electronic device according to an embodiment of the disclosure.

FIG. 3 is a schematic diagram of a portion of an active region of an electronic device according to an embodiment of the disclosure. The components shown in FIG. 3 may be applied to the electronic device 100 depicted in FIG. 1 as an exemplary embodiment of the active region 112 of the electronic device 100. Therefore, the same reference numbers in FIG. 3 and FIG. 1 are configured to denote the same components. However, the components depicted in FIG. 3 are provided for illustrative purposes, and the design of the components in the active region 112 depicted in FIG. 1 is not limited thereto. In FIG. 3, the components disposed in the active region 112 include a plurality of scan signal transmission elements SL, a plurality of data lines DL, and a plurality of pixel structures PX. Each of the scan signal transmission elements SL includes a pair of a selection line SL1 and a grouping line SL2. The data lines DL intersect the selection lines SL1 and the grouping lines SL2. The pixel structures PX are arranged in an array, and each of the pixel structures PX is connected to one of the selection lines SL1, one of the grouping lines SL2, and one of the data lines DL. In some embodiments, each of the pixel structures PX may include two switch elements (for instance, transistors) TFT1 and TFT2, and a pixel capacitor PC. A first terminal of the switch element TFT1 is connected to the selection line SL1, a second terminal of the switch element TFT1 is connected to another switch element TFT2, and a third terminal of the switch element TFT1 is connected to the pixel capacitor PC. A first terminal of the switch element TFT2 is connected to the grouping line SL2, a second terminal of the switch element TFT2 is connected to one of the data lines DL, and a third terminal of the switch element TFT2 is connected to the second terminal of the switch element TFT1.

In addition, the electronic device also includes a plurality of first signal lines 120 and a plurality of grouping signal lines 140 around the active region 112. In the embodiment, each of the selection lines SL1 may be connected to one of the first signal lines 120, and each of the grouping lines SL2 may be connected to one of the grouping signal lines 140. In addition, the grouping lines SL2 of N scan signal transmission elements SL consecutively arranged may be connected to the same grouping signal line 140, so as to divide the scan signal transmission elements SL into a plurality of scan line groups GA, GB, GC, etc. In the same scan line group GA, GB, or GC, the selection lines SL1 of N scan signal transmission elements SL consecutively arranged are connected to different first signal lines 120 in sequence.

In FIG. 3, N is 5, for instance, while N in other embodiments may be other positive integers, such as 8, 16, or the like. For instance, in the scan line group GA, the grouping lines SL2 of five consecutive scan signal transmission elements SL are connected to the same grouping signal line 140A; in the scan line group GB, the grouping lines SL2 of five consecutive scan signal transmission elements SL are connected to the same grouping signal line 140B; in the scan line group GC, the grouping lines SL2 of five consecutive scan signal transmission elements SL are connected to the same grouping signal line 140C. In addition, in the scan line group GA, the selection lines SL1 of five scan signal transmission elements SL consecutively arranged are sequentially connected to the first signal lines 120A, 120B, 120C, 120D, and 120E. The selection lines SL1 in the scan line group GB and the scan line group GC may also be sequentially connected to the first signal lines 120A, 120B, 120C, 120D and 120E. As such, although each of the first signal lines 120A, 120B, 120C, 120D, and 120E is connected to a plurality of selection lines SL1, the corresponding pixel structure PX may be turned on only when the corresponding grouping signal line 140 provides an on signal. In other words, under the grouping of the grouping signal lines 140, more than one selection line SL1 may share the same first signal line 120, which is conducive to the reduction of the number of first signal lines 120 and the reduction of the size of the side frame.

In FIG. 3, the first signal lines 120 extend outward to be the first signal lines 120 in FIG. 1 and are connected to the driving circuit IC in FIG. 1. In addition, after the data lines DL extend out of the active region 112, the data lines DL become the second signal lines 130 in FIG. 1. In other words, when the design of the active region 112 is achieved in form of the structure shown in FIG. 3, the data lines DL and the second signal lines 130 are the same continuous conductive circuit, which should however not be construed as a limitation in the disclosure.

The grouping signal lines 140 may determine that the pixel structure PX of one of the scan line groups GA, GB, and GC may be electrically connected to the data line DL. For instance, the grouping signal lines 140 may perform a selection operation to turn on the switch element TFT2 in one of the scan line groups GA, GB, or GC and turn off the switch element TFT2 in the other scan line groups GA, GB, and GC. Therefore, only the pixel structure PX corresponding to the turned-on switch element TFT2 may receive the signal from the data line DL. During the display period, the first signal lines 120A-120E may sequentially transmit the selection signal, and the grouping signal lines 140A-140C may sequentially transmit the grouping signal. Here, the grouping signal transmitted on the grouping signal lines 140A-140C may last for a sufficient time period to allow the first signal lines 120A-120E to be scanned in sequence. For instance, during the period when the grouping signal line 140A transmits a group signal to turn on the switch element TFT2 in the scan line group GA, the first signal lines 120A-120E may sequentially transmit the selection signal to the selection line SL1 in the scan line group GA. At this time, both the switch element TFT1 and the switch element TFT2 in the scan line group GA are turned on, so that the corresponding pixel structure PX may receive the signal on the data line DL. However, neither the switch element TFT2 in the scan line group GB nor the switch element TFT2 in the scan line group GC is turned on, so that the pixel structures PX in the scan line group GB and the scan line group GC do not receive the signal transmitted on the data line DL.

Similarly, during the period when the grouping signal line 140B transmits a grouped signal to turn on the switch element TFT2 in the scan line group GB, the first signal lines 120A-120E may sequentially transmit the selection signal to the corresponding selection line SL1. At this time, both the switch element TFT1 and the switch element TFT2 in the scan line group GB are turned on, so that the corresponding pixel structure PX may receive the signal on the data line DL. However, neither the switch element TFT2 in the scan line group GA nor the switch element TFT2 in the scan line group GC is turned on, so that the pixel structures PX in the scan line group GA and the scan line group GC do not receive the signal transmitted on the data line DL. With said multiplexing (multiplexing) driving design, the number of first signal lines 120 may be less than the number of the scan signal transmission elements SL, the number of the selection lines SL1, or the number of the grouping lines SL2, which is conducive to the reduction of the number of peripheral circuits and the layout area.

Figure 4:
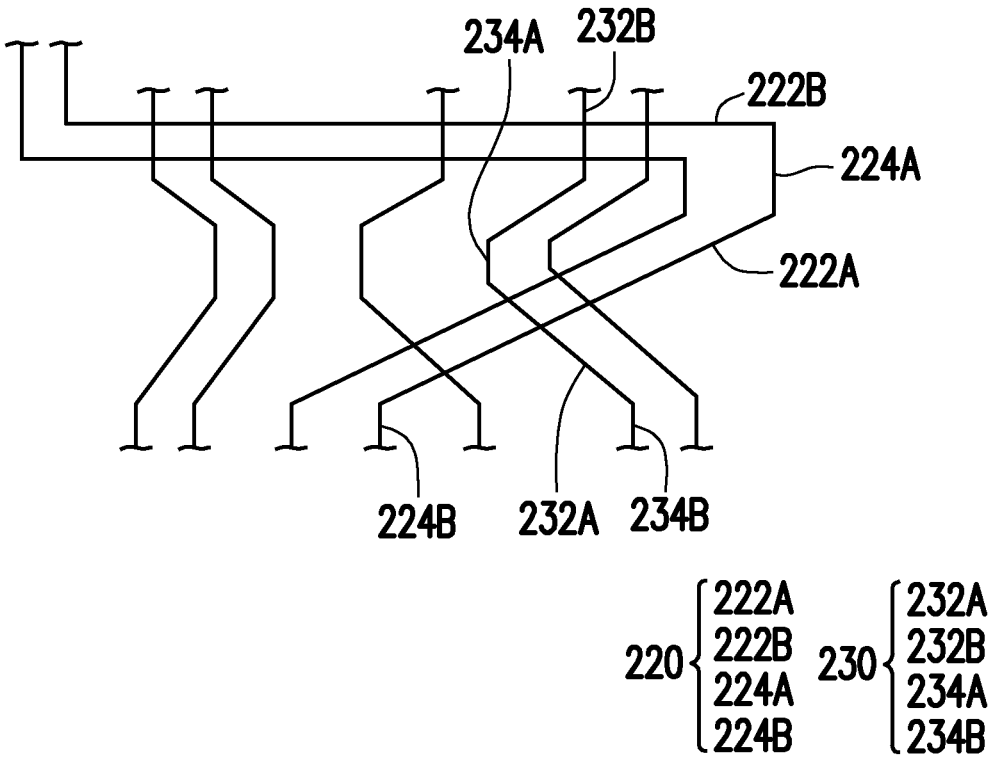
FIG. 4 is a schematic diagram of a circuit layout of an electronic device according to another embodiment of the disclosure.

FIG. 4 is a schematic diagram of a circuit layout of an electronic device according to another embodiment of the disclosure. The first signal lines 220 and the second signal lines 230 in FIG. 4 may be applied to the electronic device 100 depicted in FIG. 1 to replace the first signal lines 120 and the second signal lines 130 and connected between the active region 112 and the driving region 114. In FIG. 4, each of the first signal lines 220 includes two first intersecting sections 222A and 222B and a plurality of first extending sections 224A, 224B, and so on. Here, the first extending section 224A is connected between the two first intersecting sections 222A and 222B, which should however not be construed as a limitation in the disclosure. In addition, each of the second signal lines 230 includes two second intersecting sections 232A and 232B and a plurality of second extending sections 234A, 234B, and so on. The second extending section 234A is connected between the two second intersecting sections 232A and 232B, which should however not be construed as a limitation in the disclosure.

In FIG. 4, each of the two first intersecting sections 222A and 222B respectively has a constant extending direction, and the extending directions of the two first intersecting sections 222A and 222B are different. At the same time, each of the two second intersecting sections 232A and 232B respectively has a constant extending direction, and the extending directions of the two second intersecting sections 232A and 232B are different. That is, each of the first intersecting sections 222A and 222B is a straight line segment, and each of the second intersecting sections 232A and 232B is a straight line segment. The first intersecting section 222A interlaces with the second intersecting section 232A, and the first intersecting section 222B interlaces with the second intersecting section 232B. In addition, neither the first extending section 224A nor the first extending section 224B interlaces with any line segment of the second signal lines 230, and neither the second extending section 234A nor the second extending section 234B interlaces with any line segment of the first signal lines 220. Specifically, except for the two first intersecting sections 222A and 222B, each of the first signal lines 220 does not interlace with the second signal lines 230. Similarly, except for the two second intersecting sections 232A and 232B, each of the second signal lines 230 does not interlace with the first signal lines 220.

In the embodiment, the number of intersections where different first intersecting sections 222A interlace with the second signal lines 230 is the same, and the number of intersections where different first intersecting sections 222B interlace with the second signal lines 230 is the same. Moreover, each of the first intersecting section 222A, the first intersecting section 222B, the second intersecting section 232A, and the second intersecting section 232B respectively has a constant or substantially constant line width. Therefore, the resistance-capacitance delay effect experienced by different first signal lines 220 due to intersections of the first signal lines 220 and the second signal lines 230 is approximately the same, so that different first signal lines 220 may achieve a consistent signal transmission effect. Similarly, different second signal lines 230 may also achieve approximately the same signal transmission effect. As such, the circuit layout depicted in FIG. 4 may be applied to the electronic device 100 depicted in FIG. 1 to improve the quality.

To sum up, in the electronic device provided in one or more embodiments of the disclosure, each signal line disposed between the active region and the driving region may be divided into an intersecting section and an extending section, and the signal lines with different extending directions intersect with each other only in the intersecting sections. In addition, as to the signal lines (such as the first signal lines or the second signal lines provided in one or more embodiments of the disclosure) which transmit signals of the same type, the number of intersections on different signal lines is the same, and thereby the signal lines are subject to similar resistance-capacitance delay effect and may achieve similar signal transmission quality. Therefore, the electronic device may have the desired quality.

It will be apparent to those skilled in the art that various modifications and variations can be made to the disclosed embodiment without departing from the scope or spirit of the disclosure. In view of the foregoing, it is intended that the disclosure covers modifications and variations provided that they fall within the scope of the following claims and their equivalents.

What is claimed is:

1. An electronic device, comprising:

a substrate;

a plurality of first signal lines, disposed on the substrate, each of the plurality of first signal lines comprising at least one first intersecting section and at least one first extending section, wherein each of the at least one first intersecting section is a straight line segment, the at least one first intersecting section is connected to the at least one first extending section, and the at least one first intersecting section and the at least one first extending section have respective expending directions; and a plurality of second signal lines, disposed on the substrate and interlacing with the plurality of first signal lines to form a plurality of intersections on each of the plurality of first signal lines, all of the plurality of intersections being located on the at least one first intersecting section, wherein the at least one first intersecting section has a constant line width.

2. The electronic device according to claim 1, wherein a quantity of the at least one first extending section is two, and the at least one first intersecting section is located between the two first extending sections to form two first corners at two ends of the at least one first intersecting section.

3. The electronic device according to claim 2, the plurality of intersections being located between the two first corners.

4. The electronic device according to claim 1, wherein each of the plurality of second signal lines comprises a second intersecting section and two second extending sections, and the second intersecting section is located between the two second extending sections to form two second corners at two ends of the second intersecting section.

5. The electronic device according to claim 4, the plurality of intersections being located between the two second corners.

6. The electronic device according to claim 4, wherein the second intersecting section has a constant line width.

7. The electronic device according to claim 1, wherein the substrate has an active region and a driving region, and the plurality of first signal lines and the plurality of second signal lines extend between the active region and the driving region.

8. The electronic device according to claim 7, further comprising a plurality of scan lines, a plurality of data lines, and a plurality of active devices, the plurality of scan lines, the plurality of data lines, and the plurality of active devices being disposed on the substrate and located in the active region, wherein each of the plurality of active devices is connected to one of the plurality of scan lines and one of the plurality of data lines.

9. The electronic device according to claim 8, the plurality of scan lines being connected to the plurality of first signal lines, the plurality of data lines being connected to the plurality of second signal lines.

10. The electronic device according to claim 9, wherein at least two of the plurality of scan lines are connected to one of the plurality of first signal lines.

11. The electronic device according to claim 7, further comprising a driving circuit disposed on the substrate and located in the driving region.

12. The electronic device according to claim 11, wherein the driving circuit comprises chip on glass or chip on film.

13. The electronic device according to claim 1, wherein the at least one first extending section does not interlace with or overlap the plurality of second signal lines.

14. The electronic device according to claim 4, wherein the second extending section does not interlace with or overlap the plurality of first signal lines.

15. The electronic device according to claim 1, wherein a quantity of the at least one first intersecting section is two, the at least one first extending section is connected between the two first intersecting sections, each of the first intersecting sections is a straight line segment, and the two first intersecting sections are not parallel.

16. The electronic device according to claim 15, wherein except for the two first intersecting sections, none of the plurality of first signal lines interlace with the plurality of second signal lines.

17. The electronic device according to claim 15, wherein each of the plurality of second signal lines comprises two second intersecting sections and a second extending section, the second extending section is connected between the two second intersecting sections, each of the second intersecting sections is a straight line segment, and the two second intersecting sections are not parallel.

18. The electronic device according to claim 17, wherein except for the two second intersecting sections, none of the plurality of second signal lines interlace with the plurality of first signal lines.

* * * * *